US005617970A

United States Patent [19]

Lee

[11] Patent Number: 5,617,970

[45] Date of Patent: Apr. 8, 1997

[54] PROTECTOR FOR DRINK OPENING

[76] Inventor: Hae B. Lee, 5836 Jackson's Oak Ct., Burke, Va. 22015

[21] Appl. No.: 583,546

[22] Filed: Jan. 5, 1996

[51] Int. Cl.[6] ..... B65D 1/40

[52] U.S. Cl. ..... 220/730; 220/269; 220/906

[58] Field of Search ..... 220/729, 730, 220/258, 259, 269, 906, 716; 413/1, 14, 16, 25

[56] References Cited

U.S. PATENT DOCUMENTS

| | | | |
|---|---|---|---|
| 4,537,326 | 8/1985 | Morehead | 220/269 |
| 4,901,877 | 2/1990 | Hall | 220/269 X |
| 4,938,379 | 7/1990 | Keller | 220/370 |
| 5,054,640 | 10/1991 | Tucker | 220/716 |
| 5,379,914 | 1/1995 | Martins | 220/719 |
| 5,547,100 | 8/1996 | Johnson | 220/253 |
| 5,555,993 | 9/1996 | Borkowski et al. | 220/269 |

*Primary Examiner*—Stephen K. Cronin
*Attorney, Agent, or Firm*—Patent & Trademark Services; Joseph H. McGlynn

[57] ABSTRACT

A protective cover for a drink opening in a liquid container. The cover has openings large enough to drink through but small enough to prevent insects, such as bees, from entering the liquid container. The cover contains a portion which will fit under the tear tab on a conventional drink container and the tab will secure the cover to the container, but will allow it to be removed when the container is thrown away and, thereby, reused.

5 Claims, 1 Drawing Sheet

PROTECTOR FOR DRINK OPENING

BACKGROUND OF THE INVENTION

This invention relates, in general, to liquid containers, and, in particular, to an apertured cover for a drink opening in a liquid container.

DESCRIPTION OF THE PRIOR ART

In the prior art various types of drink opening protectors have been proposed. For example, U.S. Pat. No. 4,537,326 discloses a protector for the opening in a liquid container which includes a flat cover with a plurality of openings. The cover is mounted on the liquid container by an adhesive or is a portion of the tab actuator. U.S. Pat. No. 4,938,379 discloses a protective cover for a drink opening in which the protector is part of a cover which fits over the entire top of the liquid container.

When consuming beverages from a can, especially outdoors, there is a danger that an insect, such as a bee, will be attracted by the smell of the beverage and enter the can through the drink opening. While this is an unappetizing sight, there is a greater danger if the insect is not seen and someone attempts to drink from the can. A bee sting on the lips or inside the mouth is extremely painful.

The problem has been recognized in the prior art, as evidenced by the above cited prior art references. However, the prior art makes the apertured cover a part of the can, as in the U.S. Pat. No. 4,537,326 patent, or provides the cover as part of a lid that fits over the entire can top. Both approaches, while solving the problem, introduce other disadvantages. If the cover is part of a can it will be discarded when the can is thrown away. If the user drinks from another can that does not have a protective cover, the potential problem has returned. If the cover is part of a lid which fits over the entire top of the can as in the U.S. Pat. No. 4,938,379 reference, the lid is cumbersome to carry and since it is inconvenient will be forgotten or considered not really essential. Therefore, a person might leave the cover and not have it when it is needed.

The present invention solves the problems associated with the prior art devices by providing a protective cover that is convenient to carry at all times and will not be thrown away with the drink container.

SUMMARY OF THE INVENTION

The present invention consists of a protective cover for a drink opening in a liquid container which has openings large enough to drink through but small enough to prevent insects, such as bees, from entering the liquid container. The cover contains a portion which will fit under the tear tab on a conventional drink container and the tab will secure the cover to the container, but will allow it to be removed when the container is thrown away and, thereby, reused.

It is an object of the present invention to provide a protective cover for the drink opening in a liquid container that can be reused with more than one liquid container.

It is an object of the present invention to provide a protective cover for the drink opening in a liquid container that can be secured to the liquid container so it will not be accidentally lost.

It is an object of the present invention to provide a protective cover for the drink opening in a liquid container that can be conveniently carried with a person at all times.

These and other objects and advantages of the present invention will be fully apparent from the following description, when taken in connection with the annexed drawings.

DESCRIPTION OF THE PREFERRED EMBODIMENT

Figure 1:
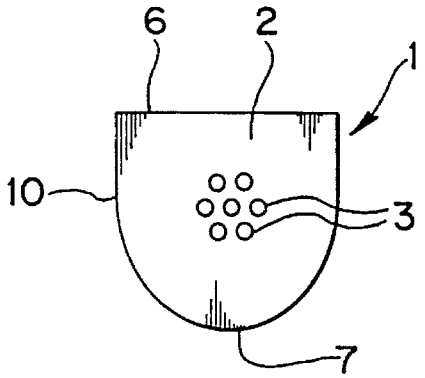
FIG. 1 is a plan view of the present invention.
Figure 2:
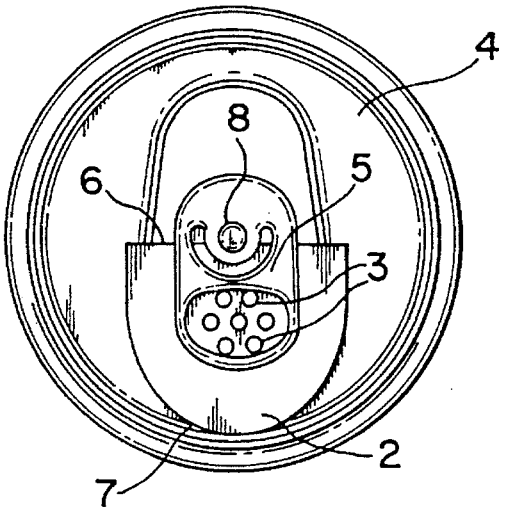
FIG. 2 is a plan view of the present invention in place on top of a liquid drink container.
Figure 3:
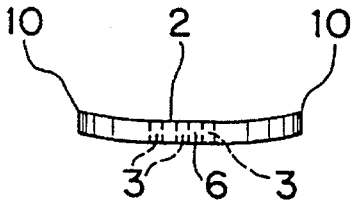
FIG. 3 is a side view of the back of the present invention.

Referring now to the drawings in greater detail, FIG. 1 shows a plan view of the protective cover 1 of the present invention. The cover has a top portion 2 which is slightly concave as shown in FIG. 3. A portion of the top 2 of the cover has a plurality of apertures 3 which are large enough so the liquid inside the container can pass through. The apertures 3 are small enough to prevent an insect, drawn by the smell of the liquid inside the container, from entering the container. The back side 6 of the cover 1 is shown as straight, however it should be understood that it can be other shapes as long as the cover will fit beneath the standard tear tab 5 as shown in FIG. 2. Also, the front of the cover 7 is shown as round to prevent a person using the cover from injuring their lips as they drink from the container. Obviously other shapes could be used for the front of the cover if they are smooth enough to prevent injury to a person using the cover.

The cover, as shown in FIG. 3 is slightly concave on the top. This will allow the cover to be captured under the conventional tear tab 5. By placing the cover 1 under the tear tab 5 the cover will be securely fastened to the top of the liquid container and there will be less chance of loosing the cover.

Figure 4:
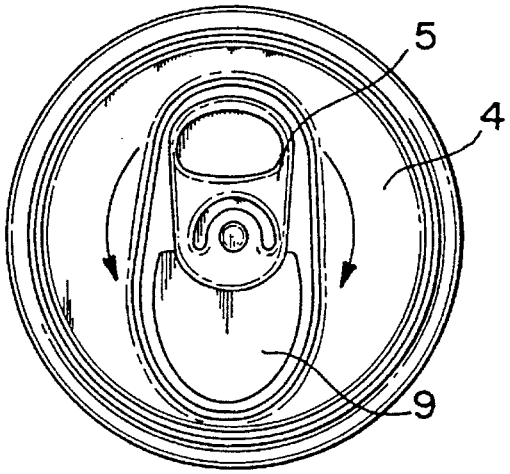
FIG. 4 is a plan view showing the standard tear tab without the drink protector of the present invention.

In order to use the cover of the present invention, after the tear tab 5 has been used to open the drink opening in the top 4 of the container, the tab will be rotated about the rivet 8 which secures the tab to the top of the container. Once the tab is rotated into the position shown in FIG. 4, the cover 1 will be placed over the drink opening 9. Then the tab 5 can be rotated back into the position shown in FIG. 2 in order to secure the cover 1 onto the top 4 of the container.

Since the tab 5 is substantially flush with the top of the container and slightly above the drink opening 9, the thickness of the cover should be slightly thicker than the distance between the bottom of the tab and the edges of the drink opening. This will be enough to provide a friction fit between the bottom of the tab 5 and the top outer edges 10 of the cover. As the tab 5 passes over the edges 10 it will raise up slightly in order to pass over the slightly higher edges. After the tab passes over the edges 10 it will drop into the concave portion in the top of the cover. This interengagement will secure the cover to the top of the drink container.

The protective cover 1 of the present invention can be made from a variety of materials including, but not limited to thin metal, metal foil and plastic.

Although the protective cover and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A protective cover for the top of a liquid drink container in combination with a tab opening device including a tab actuator, said drink container having a shearable closure which is displaced by the tab actuator to expose a container opening, and wherein said protective cover and said tab actuator comprises:

said protective cover is a substantially flat element having at least a concave central portion, said protective cover being larger than said container opening, a plurality of openings extending through said protective cover, said tab actuator is a substantially flat element having a top and a bottom surface, means for detachably securing said protective cover to said tab actuator, said means comprising said concave central portion of said protective cover which receives the bottom surface of said tab actuator, whereby said protective cover will be received and trapped between said tab actuator and said top of said liquid drink container.

2. The protective cover for the top of a liquid drink container as claimed in claim 4, wherein said cover is made from a deformable material.

3. A protective cover for the top of a liquid drink container in combination with a tab opening device including a tab actuator, said drink container having a shearable closure which is displaced by the tab actuator to expose a container opening, and wherein said protective cover and said tab actuator comprises:

said protective cover and said tab actuator are separate elements, said protective cover is a substantially flat element having at least a concave central portion, said protective cover being larger than said container opening, a plurality of openings extending through said protective cover, said tab actuator is a substantially flat element having a top and a bottom surface, means for detachably securing said protective cover to said tab actuator, said means comprising said concave central portion of said protective cover which receives the bottom surface of said tab actuator, whereby said protective cover will be received and trapped between said tab actuator and said top of said liquid drink container.

4. The protective cover for the top of a liquid drink container as claimed in claim 3, wherein said cover is made from a deformable material.

5. A method of securing a protective cover to the top of a liquid drink container, said cover having a plurality of openings extending through said protective cover and a concave shape so that the protective cover is higher at its edges than at the center of said protective cover, said liquid drink container having a tab opening device including a tab actuator and a shearable closure which is displaced by said tab actuator to expose a container opening, said method comprising:

raising said tab actuator to open said shearable closure and thereby create a drink opening in a top of said liquid drink container, depressing said tab actuator until it is substantially flush with said top of said liquid drink container, placing said protective cover over said drink opening, rotating said tab actuator until said tab actuator is over said protective cover, whereby said tab actuator will detachably secure said protective cover over said drink opening in said liquid drink container.

* * * * *